US009889690B2

(12) United States Patent
Hayashi

(10) Patent No.: US 9,889,690 B2
(45) Date of Patent: Feb. 13, 2018

(54) PRINTING APPARATUS

(71) Applicant: SEIKO EPSON CORPORATION, Tokyo (JP)

(72) Inventor: Seiya Hayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/400,810

(22) Filed: Jan. 6, 2017

(65) Prior Publication Data

US 2017/0203593 A1 Jul. 20, 2017

(30) Foreign Application Priority Data

Jan. 14, 2016 (JP) ..... 2016-005012

(51) Int. Cl.
*B41J 29/02* (2006.01)
*B41J 29/13* (2006.01)

(52) U.S. Cl.
CPC ..... *B41J 29/02* (2013.01)

(58) Field of Classification Search
CPC ... B41J 29/02; B41J 29/12; B41J 29/13; B41J 3/4078; B41J 3/4071; B41J 3/4073
See application file for complete search history.

(56) References Cited

U.S. PATENT DOCUMENTS

2004/0263544 A1* 12/2004 Kojima ..... B41J 2/165 347/5
2006/0023021 A1* 2/2006 Shimizu ..... B41J 11/007 347/34
2008/0079958 A1* 4/2008 Niimi ..... B41J 3/28 358/1.1
2009/0289970 A1* 11/2009 Matsui ..... B41J 3/4071 347/2
2012/0206552 A1* 8/2012 Uchino ..... B41J 29/13 347/108
2013/0278698 A1 10/2013 Takeuchi et al.

FOREIGN PATENT DOCUMENTS

JP 2006-240082 9/2006
JP 2013-226657 11/2013

* cited by examiner

*Primary Examiner* — Geoffrey Mruk
*Assistant Examiner* — Scott A Richmond
(74) *Attorney, Agent, or Firm* — Workman Nydegger

(57) ABSTRACT

A printing apparatus includes a printing portion that performs printing on a medium that is positioned in a printing region, a casing portion that covers the printing region, a support portion that is able to support the medium and is able to move so as to include the printing region and a set position at which the medium is set that includes at least a position outside of the casing portion on a movement path, and a cover portion that is provided so as to protrude to the set position side with respect to the casing portion and cover at least a part of the movement path of the support portion.

8 Claims, 10 Drawing Sheets

PRINTING APPARATUS

BACKGROUND

1. Technical Field

The present invention relates to a printing apparatus.

2. Related Art

In the related art, various printing apparatuses are used. Out of such printing apparatuses, there is a printing apparatus which is provided with a support portion that supports a medium and is able to move in an inner portion of a casing portion.

For example, JP A-2013-226657 discloses a printing apparatus (ink jet textile printing apparatus) that is able to move a set tray from a set position of the medium outside the casing portion up to a printing region on an inner portion of the casing portion by supporting a textile printing material as the medium using the set tray as the support portion.

However, as disclosed in JP A-2013-226657, there is a concern that foreign matter infiltrates inside the casing portion from the opening portion of the casing portion on a movement path of the support portion in a printing apparatus in the related art that is able to move the support portion from the set position of the medium on an outer portion of the casing portion up to the printing region on the inner portion of the casing portion.

SUMMARY

An advantage of some aspects of the invention is to suppress infiltration of foreign matter inside the casing portion.

According to a first aspect of the invention, there is provided a printing apparatus including a printing portion that performs printing on a medium that is positioned in a printing region, a casing portion that accommodates the printing portion and covers the printing region, a support portion that is able to support the medium and is able to move so as to include the printing region and a set position at which the medium is set that includes at least a position outside the casing portion on a movement path, and a cover portion that is provided so as to protrude to the set position side with respect to the casing portion and cover at least a part of the movement path of the support portion.

According to the aspect, the cover portion is provided so as to protrude to the set position side with respect to the casing portion and cover at least a part of the movement path of the support portion. Therefore, it is possible to suppress infiltration of foreign matter inside the casing portion from an opening portion of the casing portion in the movement path of the support portion using the cover portion.

In the printing apparatus of a second aspect of the invention, according to the first aspect, the set position may be a position at which at least a part of the support portion that is positioned at the set position is covered by the cover portion.

According to the aspect, the set position is a position at which at least a part of the support portion that is positioned at the set position is covered by the cover portion. That is, since it is possible to provide the set position at a position that is not greatly separated from the casing portion (it is possible to shorten the movement path of the support portion), it is possible to suppress an increase in size of the printing apparatus.

In the printing apparatus of a third aspect of the invention, according to the first or second aspect, the cover portion may be displaceable between a closed position that covers at least a part of the support portion that is positioned at the set position and an open position at which the support portion that is positioned at the set position is further exposed than at the closed position.

According to the aspect, the cover portion is displaceable between the closed position and the open position. Therefore, it is possible to suppress a reduction of workability when the medium is set while suppressing an increase of size of the printing apparatus.

In the printing apparatus of a fourth aspect of the invention, according to the third aspect, the cover portion may be displaceable between the closed position and the open position by sliding.

According to the aspect, the cover portion is displaceable between the closed position and the open position by sliding. Therefore, for example, it is possible for the cover portion to infiltrate inside the casing at the open position by slidably moving the cover portion and it is possible to suppress the cover portion being a hindrance when the operation of the printing apparatus is performed.

In the printing apparatus of a fifth aspect of the invention, according to the third aspect, the cover portion may be displaceable between the closed position and the open position by rotating.

According to the aspect, the cover portion is displaceable between the closed position and the open position by rotating. By configuring in this manner, it is possible to appropriately displace the cover portion.

In the printing apparatus of a sixth aspect of the invention, according to the third aspect, the cover portion may be displaceable between the closed position and the open position by displacing along with the casing portion.

According to the aspect, the cover portion is displaceable between the closed position and the open position by displacing along with the casing portion. Therefore, it is possible to simultaneously execute displacement of the cover portion and the casing portion, and it is possible to simplify opening and closing work and simplify an opening and closing mechanism of the cover portion and the casing portion.

In the printing apparatus of a seventh aspect of the invention, according to the third aspect, the cover portion may be displaceable between the closed position and the open position by being attached and detached.

According to the aspect, the cover portion is displaceable between the closed position and the open position by being attached and detached. By configuring in this manner, it is possible to appropriately displace the cover portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Example 1 (FIGS. 1 to 6B)

A recording apparatus 1 according to Example 1 of the invention will be described below in detail with reference to the attached drawings.

The printing apparatus 1 in the example is provided with a cover portion 10 (refer to FIGS. 6A and 6B) that is provided so as to protrude to the set position side of a medium with respect to a casing portion 32 and cover at least a part of a movement path of a tray 4 as a support portion of the medium. However, to begin with, since a summary of the printing apparatus 1 in the example is described, description is made in a state in which the cover portion 10 is omitted.

Figure 1:
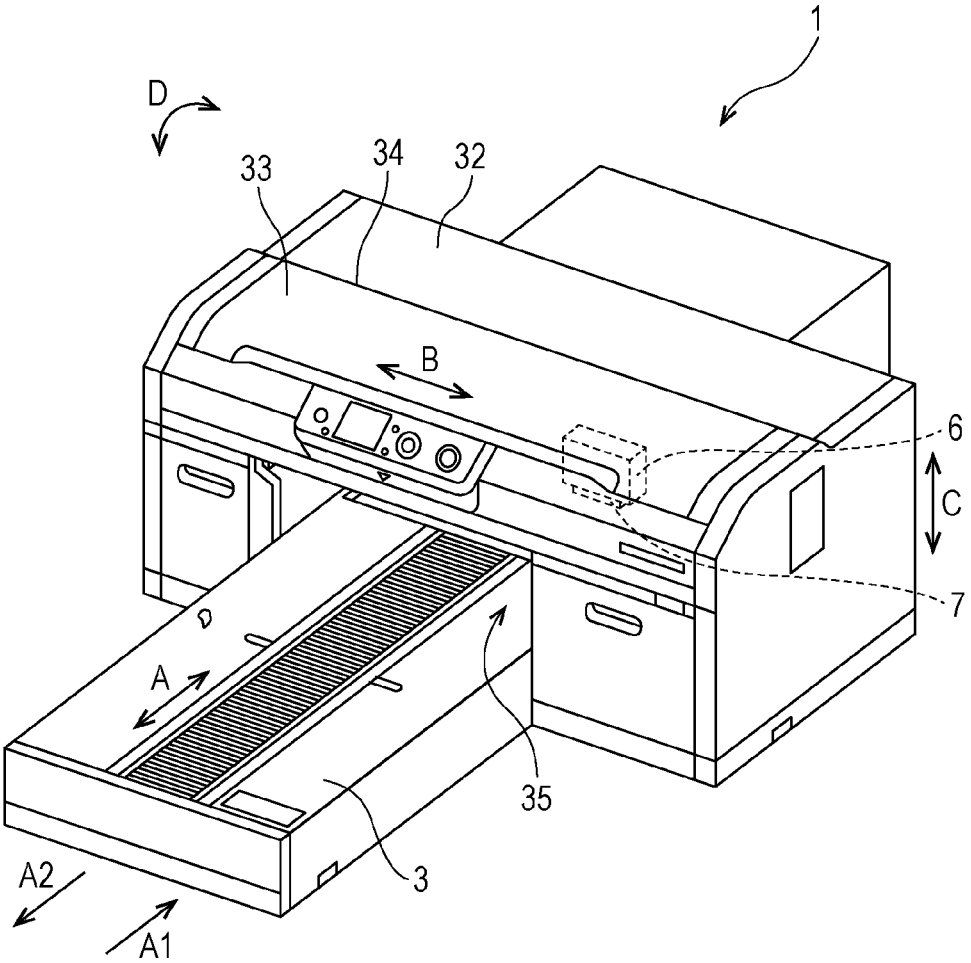
FIG. 1 is a schematic perspective view of a printing apparatus according to Example 1 of the invention.
Figure 2:
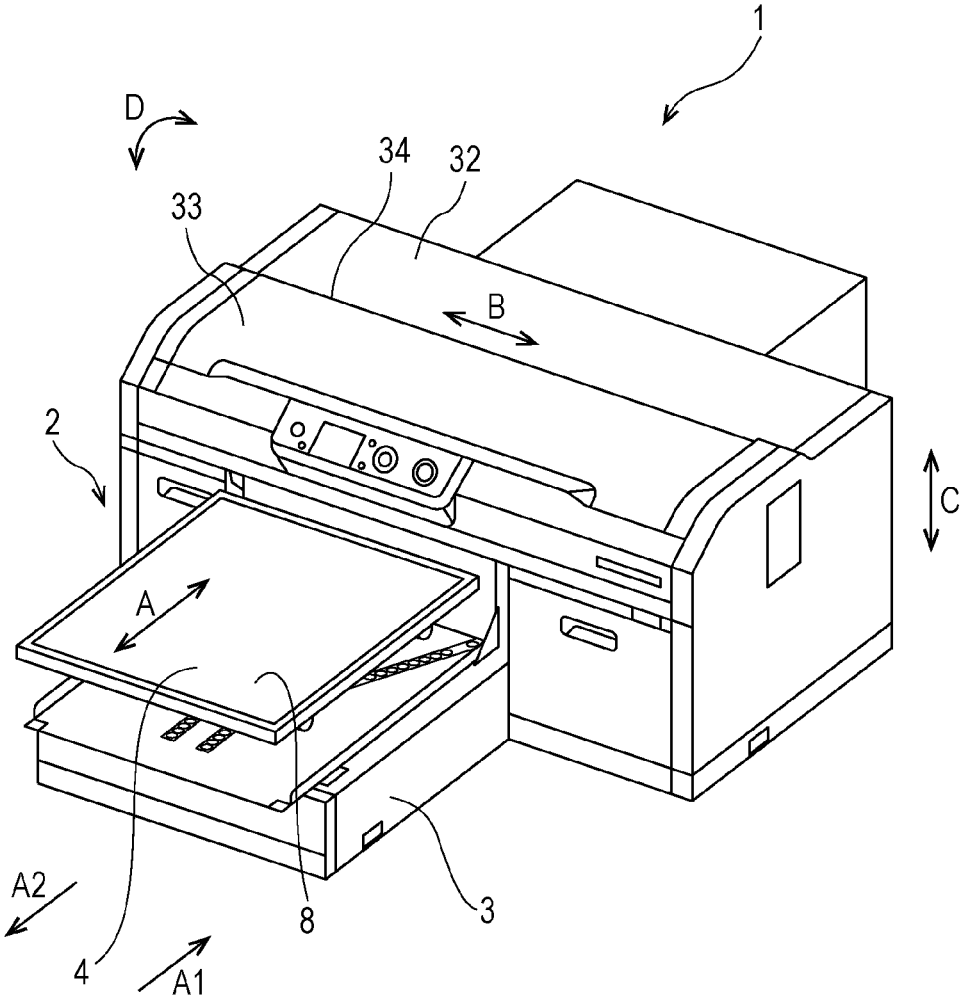
FIG. 2 is a schematic perspective view of the printing apparatus according to Example 1 of the invention.

FIGS. 1 and 2 are schematic perspective views of the printing apparatus 1 according to the example, and therein, FIG. 1 represents a state in which a tray 4 is at a printing start position as a support portion of the medium of the printing apparatus 1 in the example and FIG. 2 represents a state in which the tray 4 is at a set position of the medium.

Figure 3:
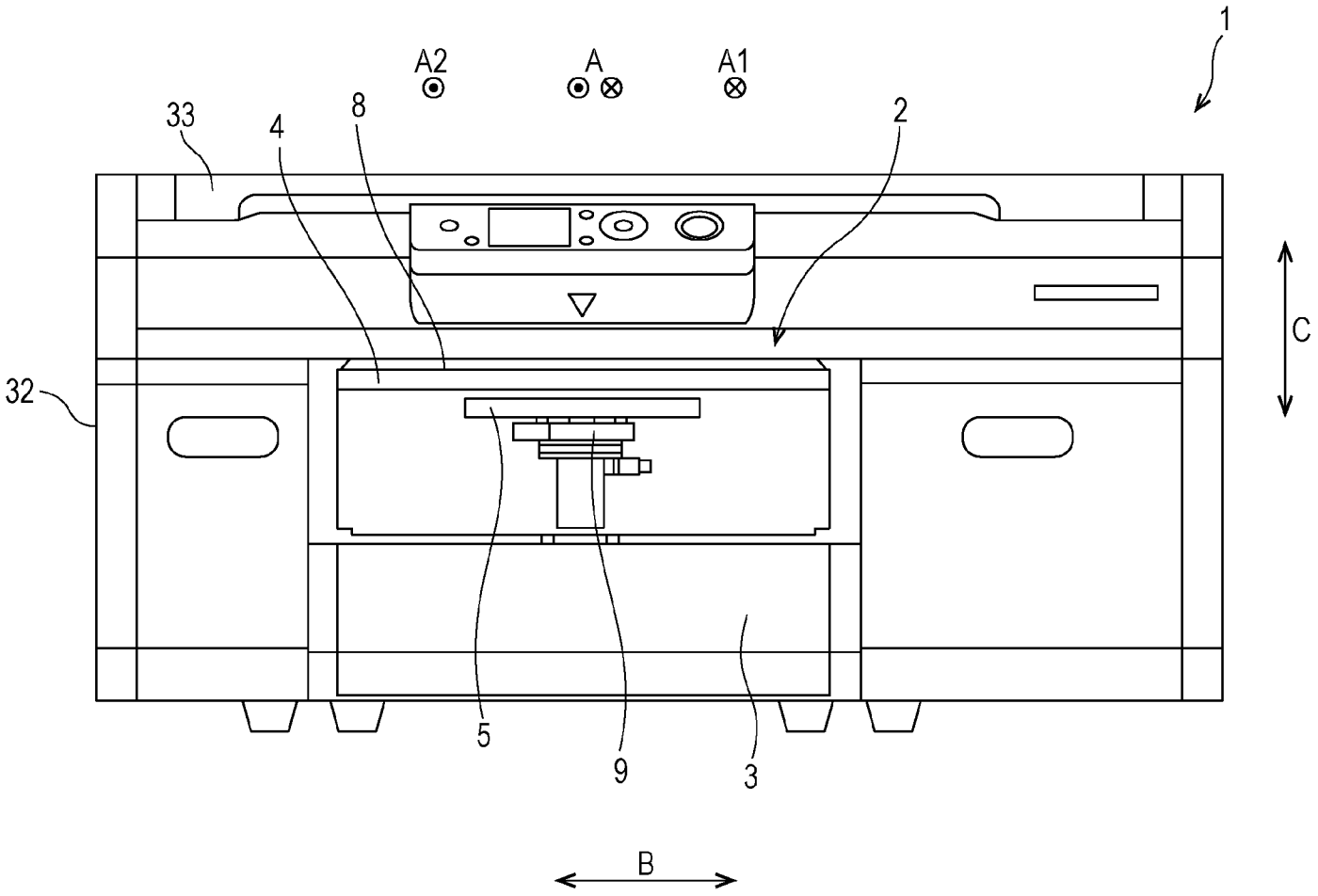
FIG. 3 is a schematic front surface view of the printing apparatus according to Example 1 of the invention.
Figure 4:
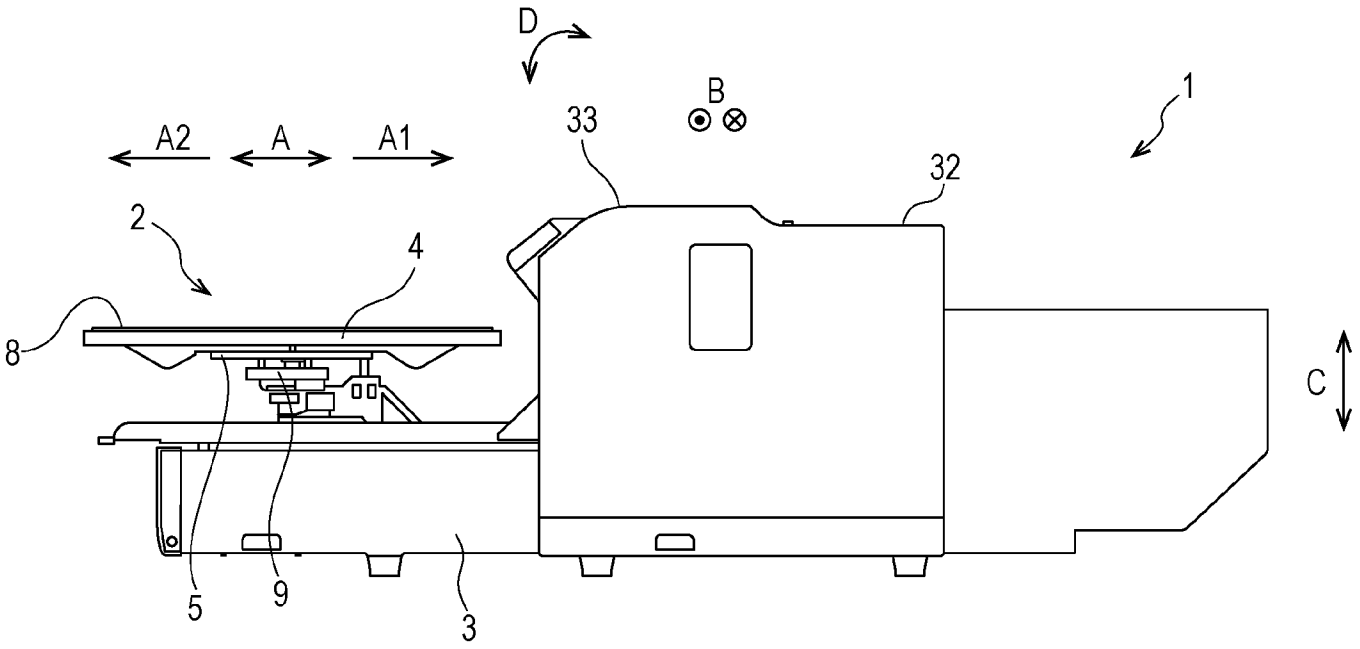
FIG. 4 is a schematic side surface view of the printing apparatus according to Example 1 of the invention.

In addition, FIG. 3 is a schematic front surface view of the printing apparatus 1 in the example, and FIG. 4 is a schematic side surface view of the printing apparatus 1 in the example.

The printing apparatus 1 in the example is provided with a medium support unit 2 that moves in a movement direction A in a state in which the medium is supported by a support surface 8 of the tray 4. The medium support unit 2 has the tray 4 that is the support portion of the medium. The printing apparatus 1 is provided with a medium transport portion 3 that transports the medium that is supported in the tray 4 in the movement direction A. The movement direction A is a direction including a direction A1 and a direction A2 that is the opposite direction from the direction A1. In addition, the tray 4 is mounted on a stage 5. The tray 4 moves in a height direction C along with the stage 5 by rotating a rotary lever 9. Note that, as represented in FIG. 4, the rotary lever 9 is provided in an arm portion of the medium support unit 2. In addition, as the medium, it is possible to use various materials such as textiles (fabric, cloth, and the like), paper, and vinyl chloride resin.

In addition, a printing head 7 that is able to discharge ink and print on the medium is provided within a main body (inside the casing portion 32) of the printing apparatus 1. Then, the printing apparatus 1 in the example forms a desired image by discharging ink from the printing head 7 on the medium that is supported on the tray 4 while reciprocally moving the printing head 7 in a scanning direction B by reciprocally moving a carriage 6 in which the printing head 7 is provided in the scanning direction B that intersects with the movement direction A. In the example, the carriage 6 in which the printing head 7 is provided is movable in the scanning direction B, and is equivalent to a printing portion that is able to print the image on the medium in a printing region (in other words, a printing portion that performs printing on the medium that is positioned in the printing region).

Note that, in the printing apparatus 1 in the example, a front side (left down direction) in FIGS. 1 and 2 is at a set position (corresponding to FIG. 2) of the medium in the tray 4. Then, after the tray 4 on which the medium is set is moved in the direction A1 out of the movement direction A up to the printing start portion (corresponding to FIG. 1) on the depth side (right up direction) in FIGS. 1 and 2, printing is performed while the tray 4 moves in the direction A2 out of the movement direction A.

Note that, the printing apparatus 1 in the example is provided with the printing head 7 that prints while reciprocally moving in the scanning direction B, but may be a printing apparatus that is provided with a so-called line head in which a plurality of nozzles that discharge ink are provided in an intersecting direction that intersects with the movement direction of the medium.

Here, "line head" is a printing head that is provided such that a nozzle region that is formed in the intersecting direction that intersects with the movement direction of the medium and used in the printing apparatus which forms the image by relatively moving the printing head or the medium. Note that, the nozzle region in the intersecting direction of the line head may not be able to cover the intersecting direction of the entire medium that corresponds to the printing apparatus.

In addition, the carriage 6 that is provided with the printing head 7 in the example is a printing portion that is able to print by discharging ink on the medium, but is not limited to such a printing portion, and for example, may use a transfer type printing portion that prints by transferring a color material on the medium.

In addition, the casing portion 32 in the example has an opening and closing portion 33, and is configured to be able to open and close the opening and closing portion 33 during replacement of the ink cartridge which is not illustrated that is able to be set in the carriage 6 and the like. Note that, any of FIGS. 1 to 4 represent a state in which the opening and closing portion 33 is closed, and the opening and closing portion 33 is configured to rotate in a rotation direction D referencing a rotary shaft 34 that extends in the scanning direction B manually by a user.

Next, an electrical configuration in the printing apparatus 1 in the example will be described.

Figure 5:
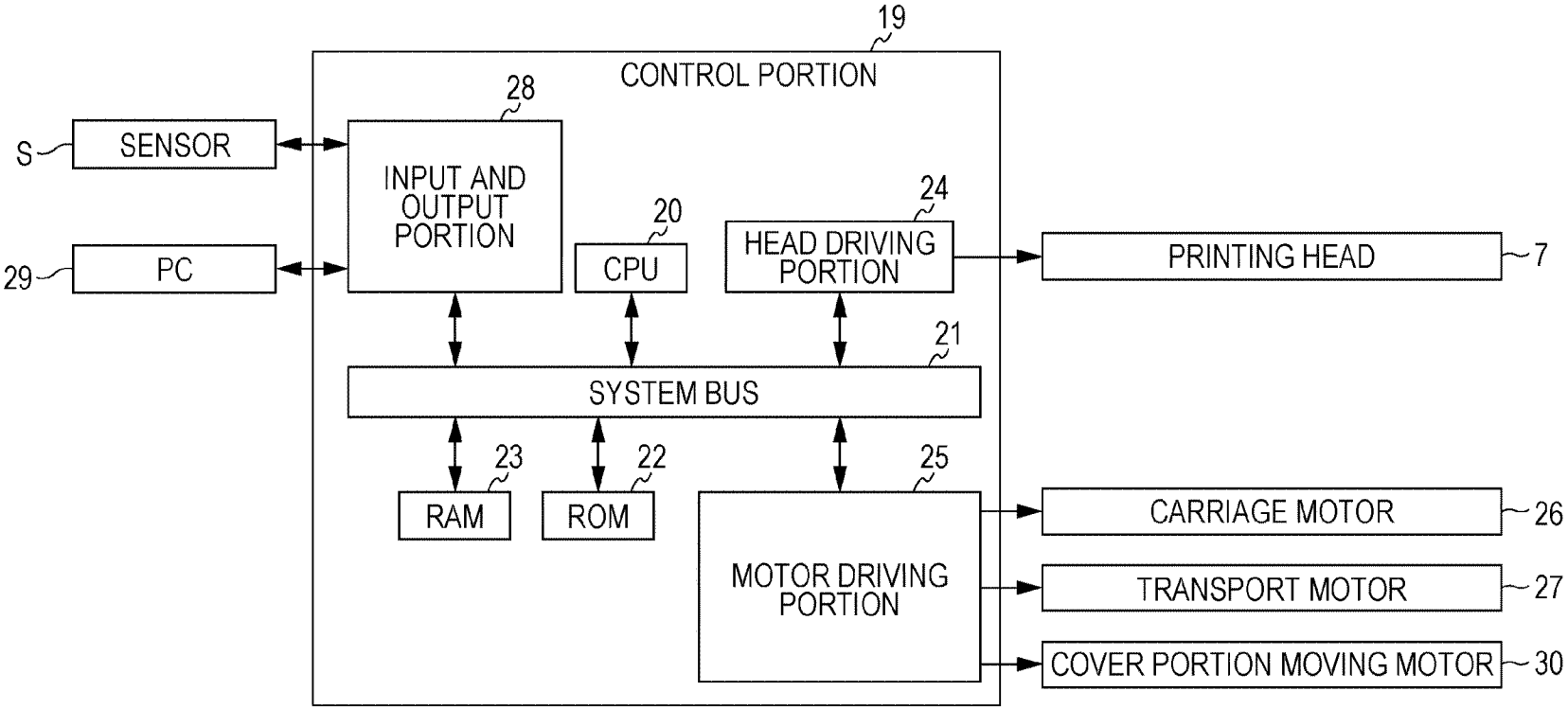
FIG. 5 is a block diagram of the printing apparatus according to Example 1 of the invention.

FIG. 5 is a block view of the printing apparatus 1 in the example.

A CPU 20 which governs overall control of the printing apparatus 1 is provided in a control portion 19. The CPU 20 is connected to a ROM 22 that stores various control programs and the like that are executed by the CPU 20 and a RAM 23 that is able to temporarily store data via a system bus 21.

In addition, the CPU 20 is connected to a head driving portion 24 for driving the printing head 7 via the system bus 21.

In addition, the CPU 20 is connected to a motor driving portion 25 via the system bus 21. Then, the motor driving portion 25 is connected to a carriage motor 26 for driving the carriage 6 in which the printing head 7 is provided, a transport motor 27 that is provided in the medium transport portion 3 for transporting the medium (that is, the medium support unit 2 is moved), and a cover portion moving motor 30 for moving the cover portion 10 which will be described later.

Furthermore, the CPU 20 is connected to an input and output portion 28 via the system bus 21. Then, the input and output portion 28 is connected to a sensor S that is able to detect that the opening and closing portion 33 is in the open state (at the open position) and the closed state (at the closed position) and a PC 29 for sending and receiving data and a signal of printing data and the like.

When the control portion 19 detects that the opening and closing portion 33 is in the open state, in a case where the carriage 6 such as during printing moves in the scanning direction B, the control portion 19 controls so as to stop movement of the carriage 6.

Next, the cover portion 10 which is a main section in the example will be described in detail.

Figure 6B:
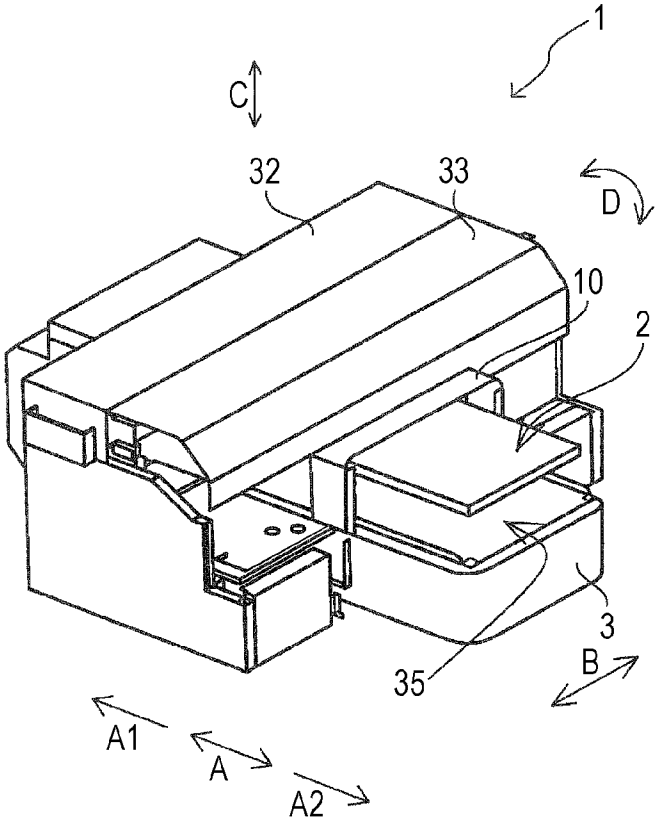
FIGS. 6A and 6B are schematic perspective views of the printing apparatus according to Example 1 of the invention.
Figure 6A:
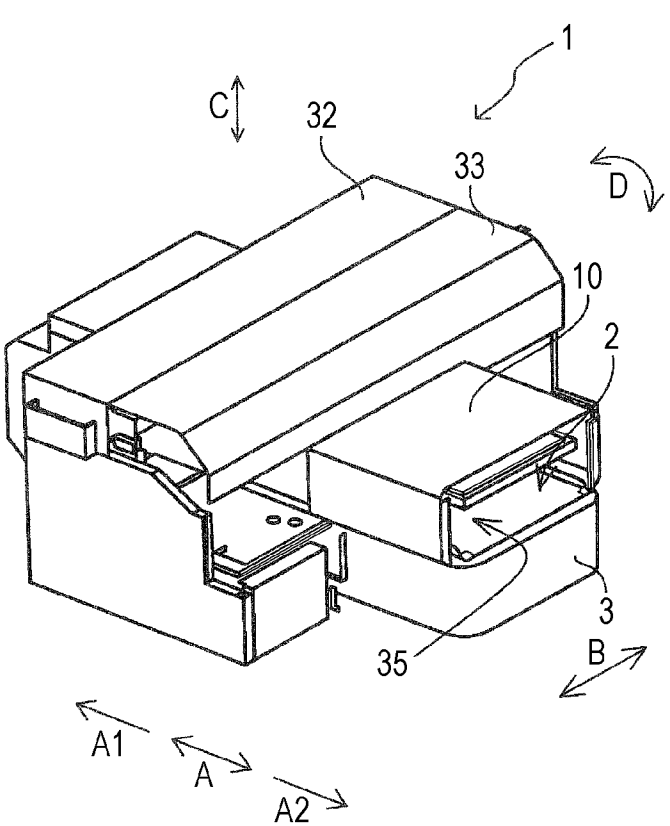

Here, FIGS. 6A and 6B are schematic perspective views of the printing apparatus 1 in the example. Therein, FIG. 6A represents a state in which the cover portion 10 is at the closed position and FIG. 6B represents a state in which the cover portion 10 is at the open position. Note that, in the same manner as FIG. 2, both of FIGS. 6A and 6B represent a state in which the tray 4 is at the set position of the medium.

As described above, the printing apparatus 1 in the example is provided with the carriage 6 that performs printing on the medium which is positioned in the printing region, the casing portion 32 that covers the printing region in which the carriage 6 is accommodated, and the tray 4 that is able to support the medium. Here, the tray 4 is configured to be movable so as to include the set position at which the medium is set that includes at least a position outside of the casing portion 32 as represented by FIGS. 2 and 6 and the printing region that includes the printing start position as represented by FIG. 1 on the movement path.

Then, as represented in FIG. 6A, the printing apparatus 1 in the example is provided with the cover portion 10 that is provided so as to protrude to the set position side with respect to the casing portion 32 and cover at least a part of the movement path of the tray 4. Therefore, there is a configuration in which it is possible to suppress infiltration of foreign matter inside the casing portion 32 from the opening portion 35 of the casing portion 32 in the movement path of the tray 4 using the cover portion 10.

In addition, as represented in FIG. 6A, the set position of the medium in the printing apparatus 1 in the example is a position at which at least a part of the tray 4 that is positioned at the set position is covered by the cover portion 10. That is, the set position is provided at a position that is not greatly separated from the casing portion 32 and the movement path of the tray 4 is shortened. Then, by configuring in this manner, an increase in size of the printing apparatus 1 is suppressed.

Note that, as represented in FIG. 6A, "a position at which at least a part of the tray 4 that is positioned at the set position is covered by the cover portion 10" may be a position at which at least a part of the tray 4 that is positioned at the set position is covered by the cover portion 10 in a state in which the cover portion 10 is at the closed position. However, as represented in FIG. 6B, in the printing apparatus 1 in the example, even in a state in which the cover portion 10 is at the open position, a part of the tray 4 that is positioned at the set position is covered by the cover portion 10. Therefore, an increase in size of the printing apparatus 1 is particularly effectively suppressed.

In addition, as represented in FIGS. 6A and 6B, the cover portion 10 of the printing apparatus 1 in the example is displaceable between the closed position (refer to 6A) that covers at least a part of the tray 4 which is positioned at the set position of the medium and an open position (refer to FIG. 6B) at which the tray 4 that is positioned at the set position is further exposed than at the closed position. Therefore, reduction of workability is suppressed when the medium is set while suppressing an increase of size of the printing apparatus 1.

Here, there is a configuration in which the cover portion 10 of the printing apparatus 1 in the example retreats to the opening portion 35 of the casing portion 32 by sliding along the movement direction A and is displaceable between the closed portion (refer to FIG. 6A) and the open position (refer to FIG. 6B). By configuring in this manner, it is possible for the cover portion 10 to infiltrate inside the casing at the open position by slidably moving the cover portion 10 and it is possible to suppress the cover portion 10 being a hindrance when the operation of the printing apparatus 1 is performed.

Note that, the cover portion 10 in the example is configured to be displaceable (slidably movable) between the closed position (refer to FIG. 6A) and the open position (refer to FIG. 6B) automatically corresponding to the printing operation by driving the cover portion moving motor 30 by control of the control portion 19. However, the cover portion 10 is not limited to such a configuration, and may be configured to be displaceable manually by the user between the closed position and the open position.

Figure 7:
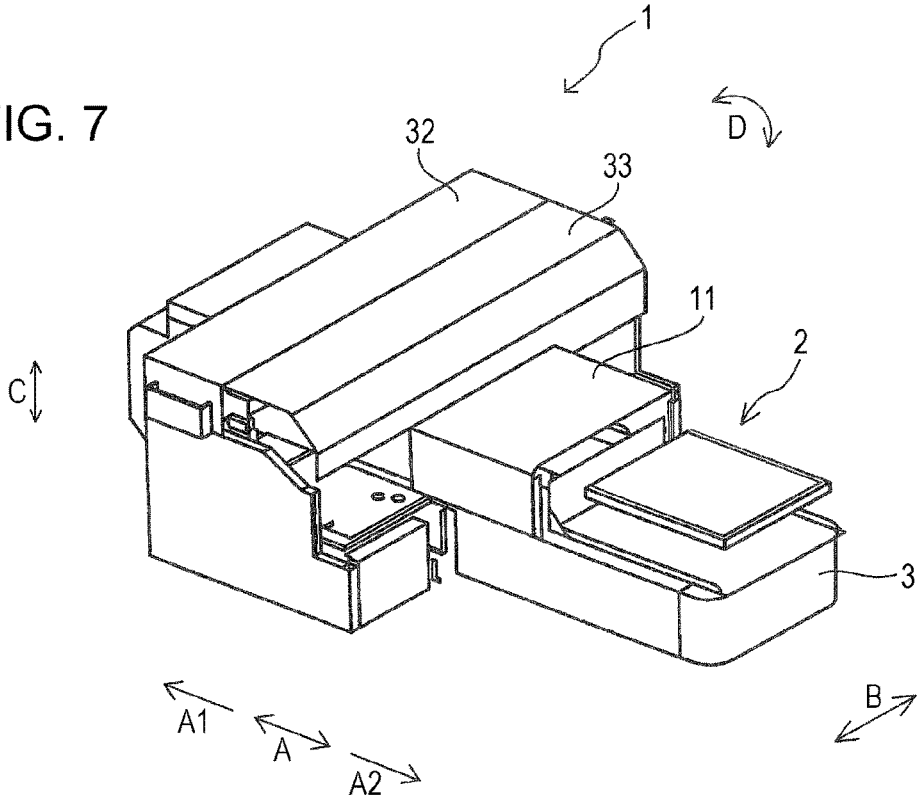
FIG. 7 is a schematic perspective view of the printing apparatus according to Example 2 of the invention.

Example 2 (FIG. 7)

Next, the recording apparatus 1 according to Example 2 of the invention will be described.

FIG. 7 is a schematic perspective view of the recording apparatus 1 in the example, and is a view which corresponds to FIGS. 6A and 6B in the recording apparatus 1 of Example 1.

Here, in the printing apparatus 1 in the example, the configuration of the cover portion and a configuration other than of presence or absence of the driving mechanism and the size (length in a direction along the movement direction A) of the medium transport portion 3 have the same configuration as the printing apparatus 1 in Example 1. Note that, the configuring members that are the same as the configuring members in the printing apparatus 1 in Example 1 are represented by the same reference numerals. Therefore, detailed description is omitted.

The cover portion 10 in Example 1 is configured to be displaceable between the closed portion (refer to FIG. 6A) and the open position (refer to FIG. 6B). Meanwhile, a cover portion 11 in the example is a fixed configuration that is fixed to the casing portion 32. Therefore, length in the direction along the movement direction A of the printing apparatus 1 is larger than the printing apparatus 1 in Example 1. However, since the cover portion 11 is the fixed type, it is possible to omit the configuring members of the cover portion moving motor 30 and the like and the apparatus configuration is simplified. In addition, as represented in FIG. 7, in the printing apparatus 1 in the example, when the tray 4 is positioned at the set position, the entirety of the tray 4 is exposed from the cover portion 10. Therefore, there is a configuration in which reduction of workability is able to be suppressed when the medium is particularly effectively set.

Figure 8:
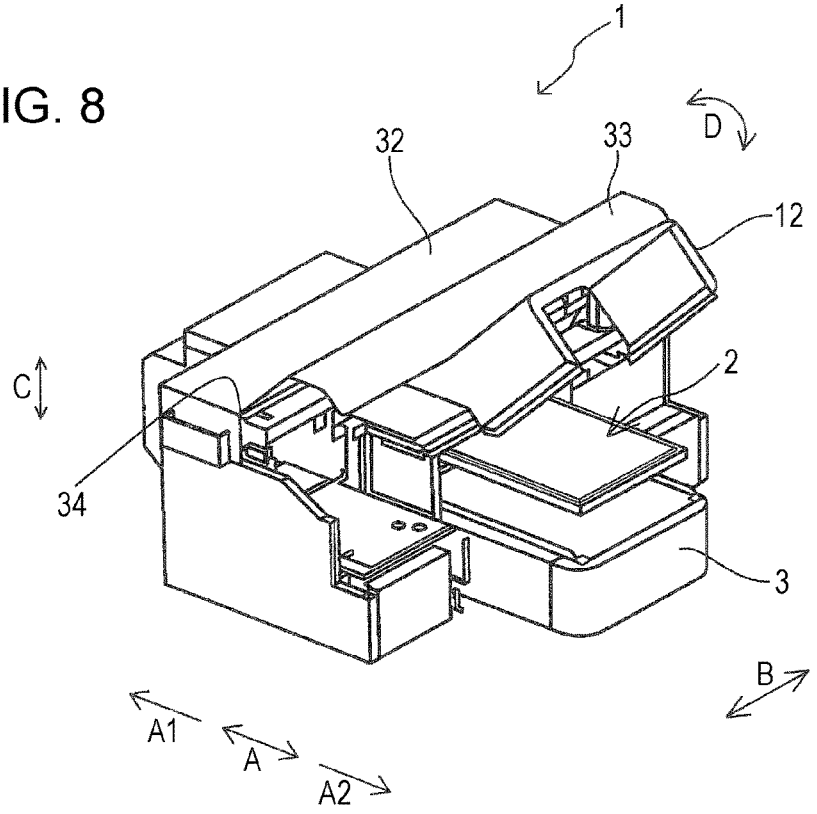
FIG. 8 is a schematic perspective view of the printing apparatus according to Example 3 of the invention.

Example 3 (FIG. 8)

Next, the recording apparatus 1 according to Example 3 of the invention will be described below.

FIG. 8 is a schematic perspective view of the recording apparatus 1 in the example, and is a view which corresponds to FIGS. 6A and 6B (in particular FIG. 6B) in the recording apparatus 1 in Example 1.

Here, in the printing apparatus 1 in the example, the configuration of the cover portion and a configuration outside of the driving mechanism has the same configuration as the printing apparatus 1 in Example 1. Note that, the configuring members that are the same as the configuring members in the printing apparatus 1 in Examples 1 and 2 are represented by the same reference numerals. Therefore, detailed description is omitted.

There is a configuration in which the cover portion 10 in Example 1 is displaceable between the closed position (refer to FIG. 6A) and the open position (refer to FIG. 6B) by sliding along the movement direction A with respect to the casing portion 32. Meanwhile, the cover portion 12 in the example is fixed to the opening and closing portion 33 that configures a part of the casing portion 32. Therefore, the cover portion 12 in the example is displace between the closed position and the open position accompanying rotation of the opening and closing portion 33 in the rotation direction D.

That is, the cover portion 12 in the example is configured to be displaced along with the opening and closing portion 33 that configures a part of the casing portion 32. That is, the cover portion 12 is displaceable between the closed position and the open position by displacing along with the casing portion 32. Therefore, it is possible to simultaneously execute displacement of the cover portion 12 and the casing portion 32, and it is possible to simplify opening and closing work and simplify an opening and closing mechanism of the cover portion 12 and the casing portion 32 (opening and closing portion 33) (omission of configuring members such as the cover portion moving motor 30 and the like).

Note that, FIG. 8 represents a state in which the cover portion 12 is displaced to the open position by displacing along with the casing portion 32.

Examples 4 to 9 (FIGS. 9 to 14)

Next, the printing apparatus 1 according to Examples 4 to 9 of the invention will be described.

FIGS. 9 to 14 are schematic perspective views of the printing apparatus 1 in the example, and is a view which corresponds to FIGS. 6A and 6B (in particular FIG. 6B) in the printing apparatus 1 in Example 1. In detail, FIG. 9 corresponds to the printing apparatus 1 in Example 4, FIG. 10 corresponds to the printing apparatus 1 in Example 5, FIG. 11 corresponds to the printing apparatus 1 in Example 6, FIG. 12 corresponds to the printing apparatus 1 in Example 7, FIG. 13 corresponds to the printing apparatus 1 in Example 8, and FIG. 14 corresponds to the printing apparatus 1 in Example 9.

Here, in the printing apparatus 1 in the examples, the configuration of the cover portion and a configuration other than of the driving mechanism has the same configuration as the printing apparatus 1 in Example 1. However, the casing portion 32 in Examples 5 to 9 has a different partial shape from the casing portion 32 in Examples 1 to 4 (a part on the set position side is not chamfered), but the casing portion 32 may be such a shape. Note that, the configuring members that are the same as the configuring members in the printing apparatus 1 in Examples 1 to 3 are represented by the same reference numerals. Therefore, detailed description is omitted.

There is a configuration in which the cover portion 10 in Example 1 is displaceable between the closed portion (refer to FIG. 6A) and the open position (refer to FIG. 6B) by sliding along the movement direction A with respect to the casing portion 32. Meanwhile, there is a configuration in which the cover portions 13 to 18 in Examples 4 to 9 are displaceable between the closed portion and the open position by rotating with respect to the casing portion 32.

In this manner, there is a configuration in which the cover portions 13 to 18 in Examples 4 to 9 are displaceable between the closed portion and the open position by rotating, and by configuring in this manner, it is possible to appropriately displace the respective cover portions.

Note that, in the printing apparatus 1 in Examples 4 to 9, the cover portions are configured to able to be manually open and closed (displaceable between the closed position and the open position) by the user. Therefore, it is possible to omit the configuring members of the cover portion moving motor 30 and the like and the apparatus configuration is simplified. However, the cover portions are not limited to such a configuration, and may be configured to be displaceable automatically between the closed position and the open position in the manner of the printing apparatus 1 in Example 1.

Examples 4 to 9 will be individually described below in detail.

Figure 9:
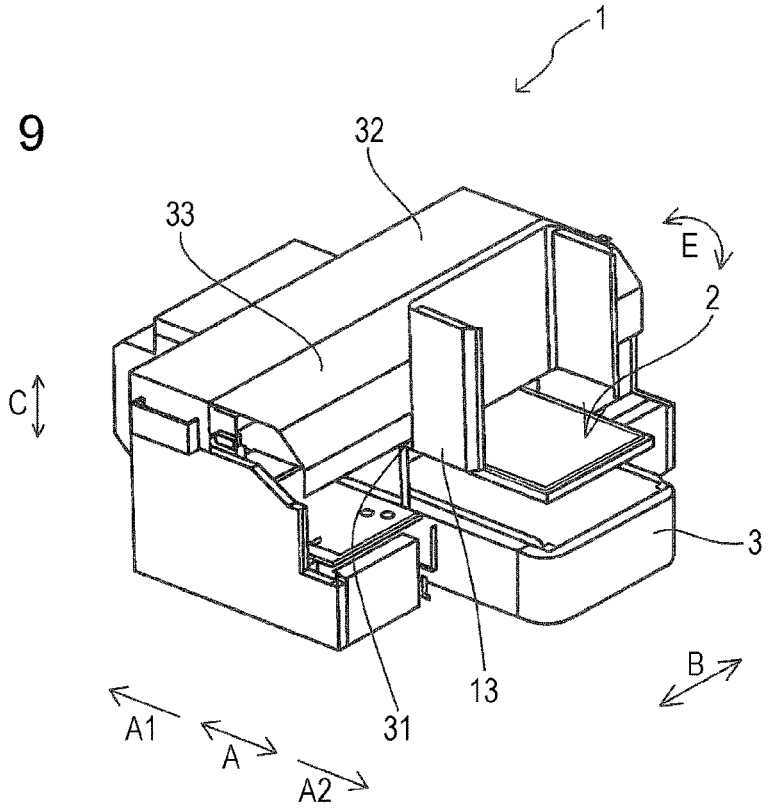
FIG. 9 is a schematic perspective view of the printing apparatus according to Example 4 of the invention.

First, as represented in FIG. 9, in the printing apparatus 1 in Example 4, the cover portion 13 is connected to the opening and closing portion 33 of the casing portion 32 via the rotary shaft 31 that extends along the scanning direction B. Then, the cover portion 13 is configured to be displaceable between the closed position and the open position along the height direction C by the cover portion 13 rotating in a rotation direction E referencing the rotary shaft 31.

Figure 10:
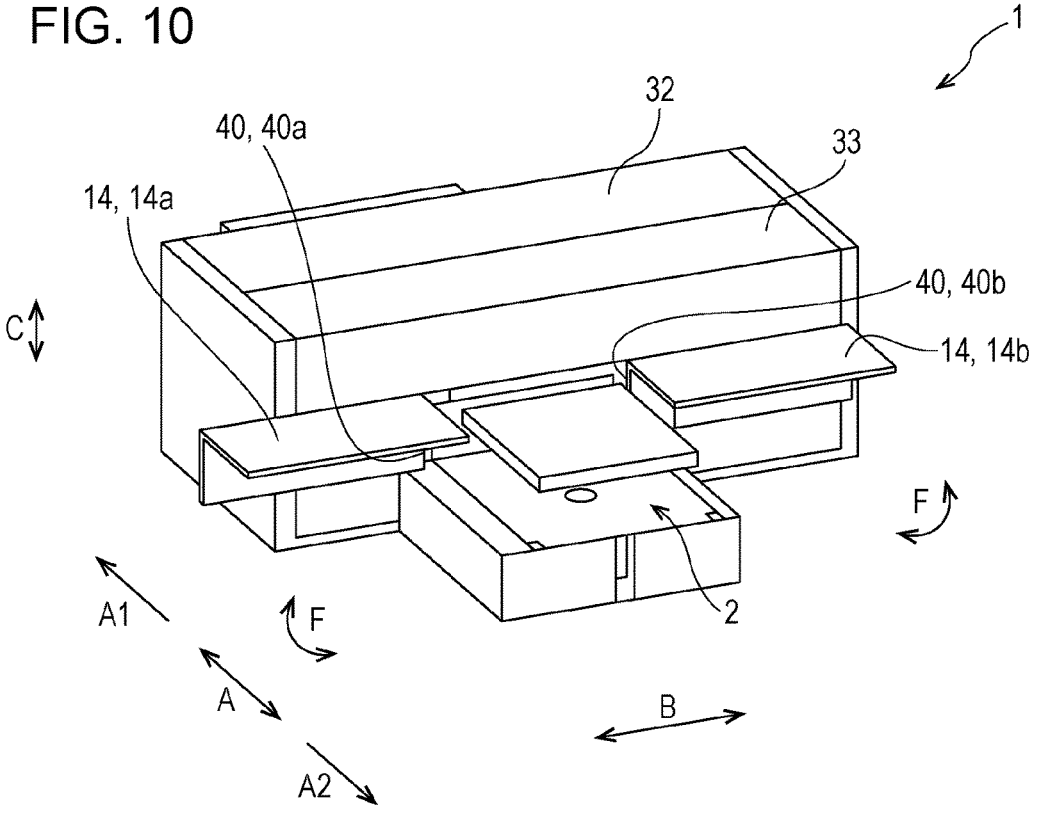
FIG. 10 is a schematic perspective view of the printing apparatus according to Example 5 of the invention.

In addition, as represented in FIG. 10, in the printing apparatus 1 in Example 5, the cover portion 14 (cover portions 14*a* and 14*b*) is connected to the casing portion 32 via the rotary shaft 40 (rotary shafts 40*a* and 40*b*) that extends along the height direction C. Then, the cover portion 14 is configured to be displaceable between the closed position and the open position along a direction that intersects with the height direction C by the cover portion 14 rotating in a rotation direction F referencing the rotary shaft 40.

Figure 11:
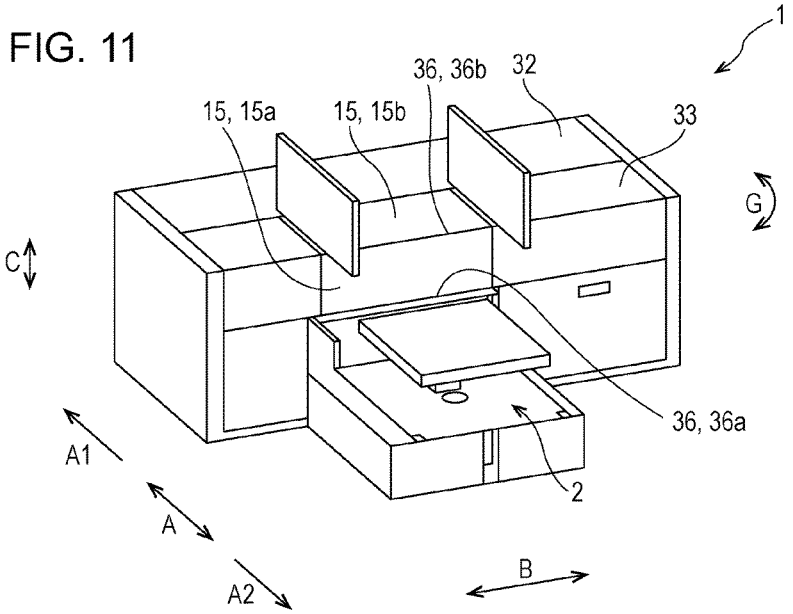
FIG. 11 is a schematic perspective view of the printing apparatus according to Example 6 of the invention.

In addition, as represented in FIG. 11, in the printing apparatus 1 in Example 6, the cover portion 15*a* out of the cover portion 15 is connected to the casing portion 32 via the rotary shaft 36*a* out of the rotary shaft 36 that extends along the scanning direction B. In addition, the cover portion 15*b* out of the cover portion 15 is connected to the cover portion 15*a* via the rotary shaft 36*b* out of the rotary shaft 36 that extends along the scanning direction B. Then, the cover portion 15 is configured to be displaceable between the closed position and the open position in two stages along the height direction C by both cover portions 15 rotating in a rotation direction G referencing both rotary shafts 36.

Figure 12:
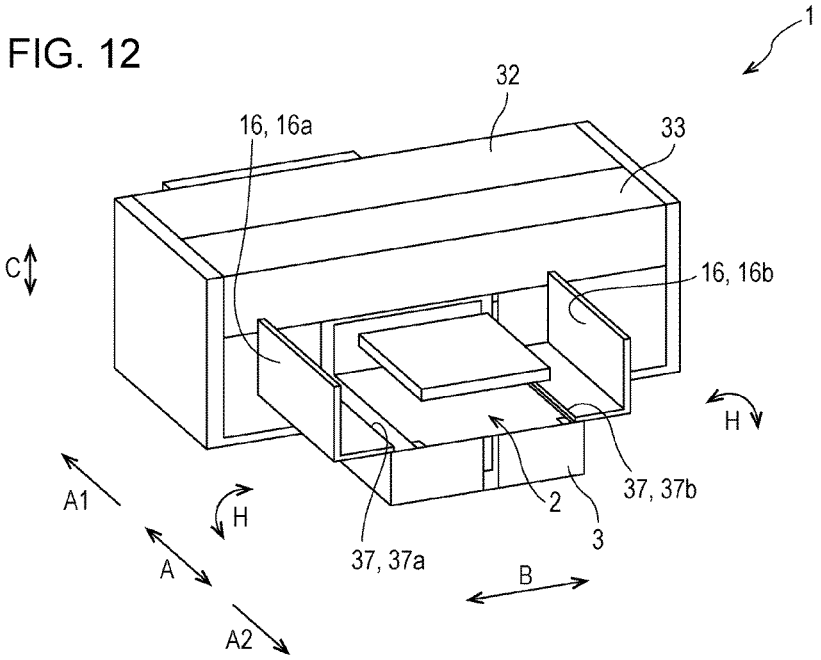
FIG. 12 is a schematic perspective view of the printing apparatus according to Example 7 of the invention.

In addition, as represented in FIG. 12, in the printing apparatus 1 in Example 7, the cover portion 16 (cover portions 16*a* and 16*b*) is connected to the end portion of the medium transport portion 3 which configures the casing portion 32 via the rotary shaft 37 (rotary shafts 37*a* and 37*b*) that extends along the movement direction A. Then, the cover portion 16 is configured to be displaceable between the closed position and the open position along a direction that intersects with the movement direction A by the cover portion 16 rotating in a rotation direction H referencing the rotary shaft 37.

Figure 13:
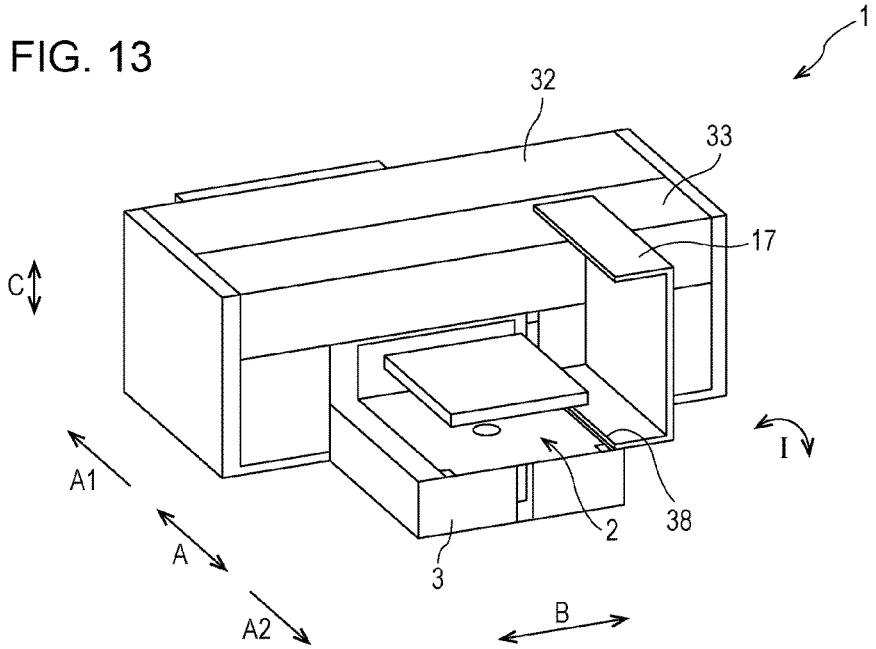
FIG. 13 is a schematic perspective view of the printing apparatus according to Example 8 of the invention.

In addition, as represented in FIG. 13, in the printing apparatus 1 in Example 8, the cover portion 17 is connected to the end portion of the medium transport portion 3 which configures the casing portion 32 via the rotary shaft 38 that extends along the movement direction A. Then, the cover portion 17 is configured to be displaceable between the closed position and the open position along a direction that intersects with the movement direction A by the cover portion 17 rotating in a rotation direction I referencing the rotary shaft 38.

Figure 14:
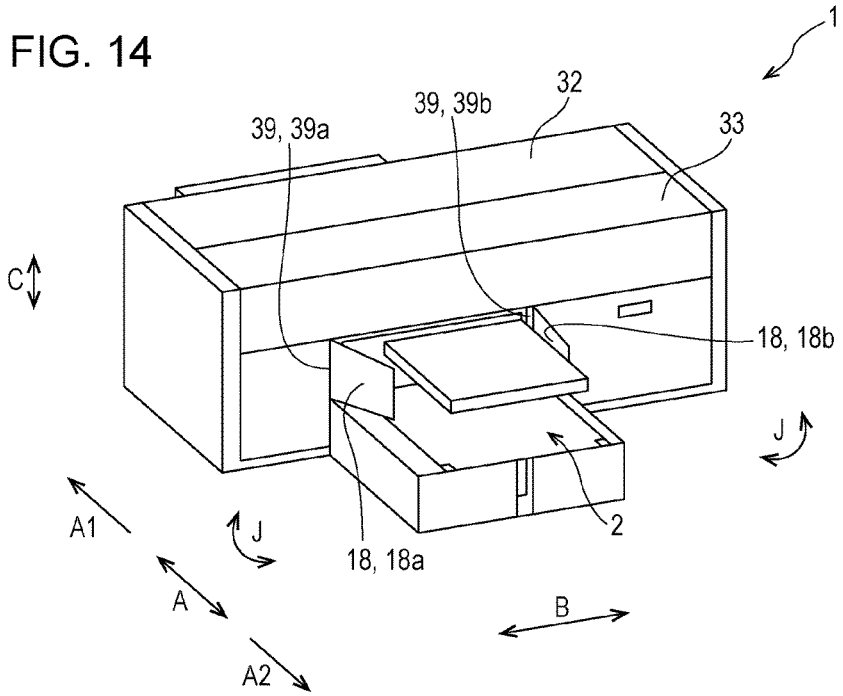
FIG. 14 is a schematic perspective view of the printing apparatus according to Example 9 of the invention.

In addition, as represented in FIG. 14, in the printing apparatus 1 in Example 9, a double door type of door shape cover portion 18 (cover portions 18*a* and 18*b*) is connected to the casing portion 32 via the rotary shaft 39 (rotary shafts 39*a* and 39*b*) that extends along the height direction C. Then, the cover portion 18 is configured to be displaceable between the closed position and the open position along a direction that intersects with the height direction C by the cover portion 18 rotating in a rotation direction J referencing the rotary shaft 39. Note that, the rotary shaft 39 is formed in a part that slightly protrudes to the set position side with respect to the casing portion 32.

Note that, the invention is not limited to the examples described above, and various modifications are possible within the scope of the invention described in the claims and can be said to be included in the scope of the invention.

For example, the cover portion may be displaceable between the closed position and the open position by being attached and detached from the printing apparatus. Even by configuring in this manner, it is possible to appropriately displace the cover portion.

This application claims priority under 35 U.S.C. §119 to Japanese Patent Application No. 2016-005012, filed Jan. 14, 2016. The entire disclosure of Japanese Patent Application No. 2016-005012 is hereby incorporated herein by reference.

What is claimed is:

1. A printing apparatus comprising:

a printing portion which performs printing on a medium that is positioned in a printing region;

a casing portion that accommodates the printing portion and covers the printing region;

a support portion that is able to support the medium and is able to move so as to include the printing region and a set position at which the medium is set that includes at least a position outside the casing portion on a movement path, and a cover portion that is provided so as to protrude to the set position side with respect to the casing portion and cover at least a part of the movement path of the support portion, the cover portion being sized to cover the support portion without covering the casing portion.

2. The printing apparatus according to claim 1, wherein the set position is a position at which at least a part of the support portion that is positioned at the set position is covered by the cover portion.

3. The printing apparatus according to claim 1, wherein the cover portion is displaceable between a closed position that covers at least a part of the support portion that is positioned at the set position and an open position at which the support portion that is positioned at the set position is further exposed than at the closed position.

4. The printing apparatus according to claim 3, wherein the cover portion is displaceable between the closed position and the open position by sliding.

5. The printing apparatus according to claim 3, wherein the cover portion is displaceable between the closed position and the open position by rotating.

6. The printing apparatus according to claim 3, wherein the cover portion is displaceable between the closed position and the open position by displacing along with the casing portion.

7. The printing apparatus according to claim 3, wherein the cover portion is displaceable between the closed position and the open position by being attached and detached.

8. The printing apparatus according to claim 1, wherein when a direction that intersects a moving direction in which the support portion moves is a width direction, a length of the cover portion in the width direction is shorter than a length of the casing portion in the width direction.

* * * * *